US006408249B1

(12) United States Patent
Teletzke

(10) Patent No.: US 6,408,249 B1
(45) Date of Patent: Jun. 18, 2002

(54) METHOD FOR DETERMINING A PROPERTY OF A HYDROCARBON-BEARING FORMATION

(75) Inventor: Gary F. Teletzke, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 154 days.

(21) Appl. No.: 09/651,640

(22) Filed: Aug. 30, 2000

Related U.S. Application Data

(60) Provisional application No. 60/156,357, filed on Sep. 28, 1999.

(51) Int. Cl.[7] ..... G06F 19/00

(52) U.S. Cl. ..... 702/12

(58) Field of Search ..... 702/12, 13; 73/152.39; 166/366, 268, 266, 245, 250.15, 250.16; 703/10

(56) References Cited

U.S. PATENT DOCUMENTS

| | | | | |
|---|---|---|---|---|
| 5,159,833 A | | 11/1992 | Graebner | 73/155 |
| 5,992,519 A | * | 11/1999 | Ramakrishnan et al. | 166/250.1 |
| 6,119,778 A | | 9/2000 | Seidle et al. | 166/263 |

OTHER PUBLICATIONS

Heffer, K. J. et al, "Novel Techniques Show Links Between Reservoir Flow Directionally, Earth Stress Fault Structure and Geomechanical Changes In Mature Waterfloods", SPE 30711, Oct. 22–25, 1995, pp. 77–87.

Jansen, F.E. et al, "Exploratory Data Analysis of Production Data", SPE 35184, Mar. 27–29, 1996, pp. 331–342.

Chou, S. I. et al, "Development of Optimal Water Control Strategies", SPE 28571, Sep. 25–28, 1994, pp. 41–51.

* cited by examiner

*Primary Examiner*—Donald E. McElheny, Jr.
(74) *Attorney, Agent, or Firm*—Gary D. Lawson

(57) ABSTRACT

A method is disclosed of estimating a property of a hydrocarbon-bearing formation penetrated by at least one injection well through which fluid is injected into the formation and penetrated by at least one production well through which fluid is produced from the formation. The injection rates of fluid through the injection wells are periodically varied and measured at substantially regular time intervals and measurements are also made of the production rate of fluid produced through the production well. A series of production well response delays, $\tau$, are selected. A set of correlation coefficients between the injection rate for each injection well and the production rate as a function of $\tau$ are determined. From each set of correlation coefficients, a time lag, $\tau_{max}$, corresponding to the maximum correlation coefficient is determined. The $\tau_{max}$ is then used to characterize a formation property, such as channel volume, permeability, or transmissibility.

10 Claims, 3 Drawing Sheets

METHOD FOR DETERMINING A PROPERTY OF A HYDROCARBON-BEARING FORMATION

This application claims the benefit of U.S. Provisional Application No. 60/156,357 filed on Sep. 28, 1999.

FIELD OF THE INVENTION

This invention relates generally to diagnosis of a hydrocarbon-bearing formation and more specifically, to a method for estimating a property of a hydrocarbon-bearing formation penetrated by injection and production wells.

BACKGROUND OF THE INVENTION

A significant fraction of the oil-in-place is left in the ground after primary recovery. Water injection, sometimes referred to as waterflooding, and gas injection, sometimes referred to as gas flooding, are used as improved oil recovery processes to recover the remaining oil. The terms "gas injection" and "gas flooding" typically refer to an oil recovery process in which the fluid injected is a hydrocarbon gas, inert gas, carbon dioxide or steam. Water and gas may be injected alternately in a process referred to as water-alternating-gas (WAG) flooding.

The success of water and gas floods can be diminished by early breakthrough of the injected water and/or gas at production wells. A particularly serious problem is early breakthrough caused by channeling of the injectant through high-permeability pathways connecting certain injection wells to the "breakthrough" production wells. The pathways may consist of thin high-permeability layers or "thief zones," networks of higher-permeability rock, or systems of natural or induced fractures. Such channeling, or poor conformance, of the injected fluid can cause it to contact and sweep only a small portion of the reservoir volume, thus limiting the amount of oil recovered and causing inefficient utilization of the injected fluid.

Channeling can be further exacerbated by unfavorable mobility and density ratios between the injected and reservoir fluids, which cause the injected fluid to finger through the resident reservoir fluids and to gravity segregate in the reservoir. Fingering and gravity segregation are particular concerns in gas or WAG injection, because gases have higher mobility and lower density than oil or water.

A variety of remedial actions have been proposed to mitigate channeling problems. The rate of fluid production at the offending production well may be reduced or the well may be shut in periodically to limit production of the injected fluid. If the source well for the unwanted production can be identified, the rate of injection at that well can be reduced. Plugging substances such as cements, gels, polymers, foams, or combinations thereof may be placed in the high-permeability pathway to block flow and divert injected fluids into other less permeable regions of the reservoir.

The choice of the most appropriate remedial action depends critically upon identifying the source well for the undesired production and characterizing the volume and transmissibility of the high-permeability pathway between the source well and the offending production well. Tracer surveys, pressure interference tests, and pressure pulse tests have been used to identify and characterize high-permeability pathways between wells. These techniques can be expensive and time-consuming because special injection and production sampling equipment and procedures are required. A significant need therefore exists for a technique that would enable rapid screening of interwell communication using readily available historical data, with minimal disruption of existing production operations.

It has been suggested that statistical correlation techniques may be applied to correlate fluctuations in injection and production rates and thereby characterize interwell communication. Statistical correlation analysis is used to determine whether two ranges of data move together, i.e., whether large values of one set (such as injection rate) are associated with large values of the other (such as production rate), corresponding to positive correlation, whether small values of one set are associated with large values of the other, corresponding to negative correlation, or whether values in both sets are unrelated, corresponding to correlation near zero.

A paper by Chou, S. I., Bae, J. H., Friedman, F., and Dolan, J. D., "Development of Optimal Water Control Strategies," SPE 28571, presented at the SPE 69th Annual Technical Conference and Exhibition, New Orleans, La., Sep. 25–28, 1994, describes a methodology for assessing the degree of communication between a water injection well and offset production wells. Random fluctuations in water injection rate were correlated with fluctuations in water production rate at surrounding wells. A high correlation coefficient was assumed to indicate the presence of a dominant thief zone. Simulations with idealized reservoir models exhibited a maximum correlation coefficient at a specific time delay, which was assumed to be caused by reservoir compressibility (mostly due to gas). However, actual field data did not exhibit a maximum correlation coefficient at a specific time delay. Rather, the correlation coefficient was uniformly high or low for all time delays. Gel treatments in injection wells having high correlation with offset high-water-cut producers resulted in generally positive producer response. However, the authors indicated that it was not possible to determine the optimal gel volume in advance; instead, it was determined by injectivity changes during gel emplacement.

A paper by Heffer, K. J., Fox, R. J., McGill, C. A., and Koutsabeloulis, N. C., "Novel Techniques Show Links between Reservoir Flow Directionality, Earth Stress, Fault Structure and Geomechanical Changes in Mature Waterfloods," SPE 30711, presented at the SPE 70th Annual Technical Conference and Exhibition, Dallas, Tex., Oct. 22–25, 1995, proposed using correlations between fluctuations in injection and production well rates to indicate communication in oil reservoirs. The direction of maximum correlation was found to correspond to the local orientation of maximum horizontal earth stresses, which was assumed to correspond to the direction of highest permeability and most rapid fluid flow. The correlation analysis assumed zero time delay between injection and production rate changes; nevertheless, significant correlations were found between wells separated by large distances.

A paper by Jansen, F. E., and Kelkar, M. G., "Exploratory Data Analysis of Production Data," SPE 35184, presented at the SPE 1996 Permian Basin Oil and Gas Recovery Conference, Midland, Tex., Mar. 27–29, 1996 proposed a method for assessing interwell communication in a waterflood. Fluctuations in water injection rate were correlated with fluctuations in water production rate at surrounding wells. The correlation was based on the assumption that a rate change in an injection well could generate a pressure pulse that translates to an instantaneous rate change in a production well; it was stated that "it is not obvious how to interpret any correlation above zero time lag." This correlation method was claimed to be a useful tool for indicating possible communication between wells. However, the authors indicated that the method has limitations caused by the complex interaction between operating conditions, reservoir response, and pressure superposition between injectors. As a result, it was suggested that the method worked best when there is a minimum of noise in the data and a strong direct relationship between the wells.

These publications suggest that correlations between fluctuations in injection rate and fluctuations in production rate may be used to indicate communication between injection and production wells. However, because the methods rely upon correlation of random fluctuations, there can be substantial ambiguity in the interpretation of the correlations. Furthermore, the methods used in the past do not provide information about formation properties (such as channel volume, permeability, or transmissibility) between the wells. Such information is critical for selection and design of remedial actions. There is a continuing need for an improved method of analysis that reduces ambiguity and enables the characterization of interwell properties.

SUMMARY

This invention provides a method of estimating a property of a hydrocarbon-bearing formation penetrated by at least one injection well, preferably a plurality of injection wells, through which fluid is injected into the formation and penetrated by at least one production well through which fluid is produced from the formation. In carrying out the method, the injection rates of fluid through the injection wells are periodically varied and measured at substantially regular time intervals. The production rate of fluid produced through the production well is also measured. A series of production well response delays, $\tau$, are selected. A set of correlation coefficients between the injection rate for each injection well and the production rate as a function of $\tau$ are determined. From each set of correlation coefficients, a time lag, $\tau_{max}$, corresponding to the maximum correlation coefficient is determined. The $\tau_{max}$ is then used to characterize a formation property, such as channel volume, permeability, or transmissibility.

BRIEF DESCRIPTION OF THE DRAWINGS

The present invention and its advantages will be better understood by referring to the following detailed description and the following drawings in which like numerals have similar functions.

Figure 1:
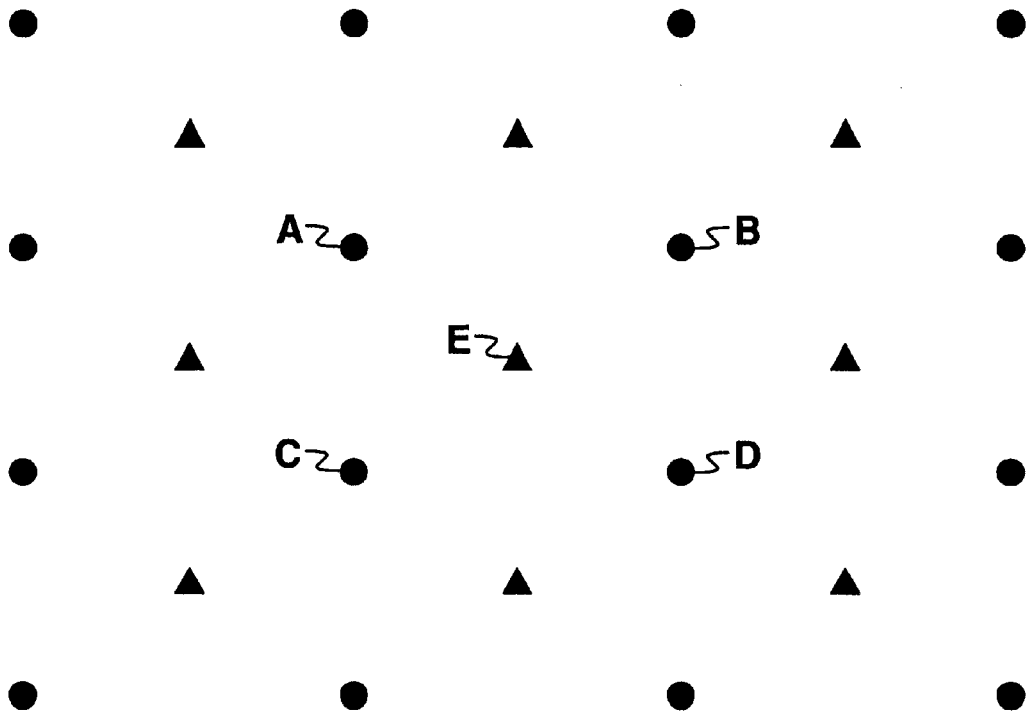
FIG. 1 schematically illustrates a well pattern of injection wells and production wells used in the example presented in the Detailed Description of the Invention.

The drawings illustrate specific embodiments of practicing the method of this invention. The drawings are not intended to exclude from the scope of the invention other embodiments that are the result of normal and expected modifications of the specific embodiments.

DETAILED DESCRIPTION OF THE INVENTION

The method of this invention provides a new technique for diagnosing interwell communication problems between injection wells and surrounding producing wells. Correlation functions between historical injection and production rate data are used to determine which injection wells are in communication with a given production well and a characteristic time lag between changes in injection rate and production rate responses. The method is particularly useful in identifying high-permeability pathways between a production well and surrounding injection wells and the method can be used to facilitate ranking volume and transmissibility of multiple high-permeability pathways that are identified using the method. Information obtained from using the method can used to design treatment strategies for diverting injectants away from highly-swept regions of the reservoir.

The method of this invention is performed by first obtaining historical data of injection rates and production rates for the wells being analyzed. The injection rates of an injection fluid through the injection wells are periodically varied and measured. The inventor is the first to recognize that cyclic variation of injection rates, with each injection well having a characteristic injection rate frequency, provides a means for interpreting production responses. The production rates of at least one component of the production fluid are also measured. A series of production well response delays, $\tau$, are selected. A set of correlation coefficients is then determined between the injection rate for each injection well and the production rate as a function of $\tau$. From each set of correlation coefficients, a maximum correlation coefficient and a time lag, $\tau_{max}$, corresponding to the maximum correlation coefficient are then determined. The $\tau_{max}$ is then used to estimate a reservoir property of the formation.

The following description of the method refers to equations having a large number of mathematical symbols, many of which are defined as they occur throughout the text. Additionally, for purposes of completeness, a table containing definitions of symbols used herein is presented following the detailed description.

In practicing the method of this invention, either the linear correlation coefficient or the rank correlation coefficient may be used. The linear correlation coefficient is a measure of linear association between two sets of data. Consider the sets of historical injection rate data I(t) for an injection well and production rate data P(t) for a production well suspected to be in communication with that injection well. The linear correlation function, $\rho_{I,P}^{L}(\tau)$, expresses the dependence of the linear correlation coefficient between the values of I(t) at time t and P(t) at a later time t+$\tau$ on the time lag $\tau$ between injection and production rate measurements:

$$\rho_{I,P}^{L}(\tau) = \frac{\mathrm{Cov}(I(t), P(t+\tau))}{\sigma_I \sigma_P}, \tag{1}$$

where the covariance between the data sets is:

$$\mathrm{Cov}(I(t), P(t+\tau)) = \frac{1}{(t_{\max} - t_{\min})} \int_{t_{\min}}^{t_{\max}} (I(t) - \mu_I)(P(t+\tau) - \mu_P)\, dt, \tag{2}$$

the standard deviations of the respective data sets are:

$$\sigma_I = \sqrt{\frac{1}{(t_{\max} - t_{\min})} \int_{t_{\min}}^{t_{\max}} (I(t) - \mu_I)^2\, dt}\,, \tag{3}$$

-continued $$\sigma_P = \sqrt{\frac{1}{(t_{\max} - t_{\min})}\int_{t_{\min}}^{t_{\max}} (P(t) - \mu_P)^2\, dt}\,, \tag{4}$$

and the means of the respective data sets are:

$$\mu_I = \frac{1}{(t_{\max} - t_{\min})}\int_{t_{\min}}^{t_{\max}} I(t)\, dt, \tag{5}$$

$$\mu_P = \frac{1}{(t_{\max} - t_{\min})}\int_{t_{\min}}^{t_{\max}} P(t+\tau)\, dt, \tag{6}$$

and $t_{max}$ and $t_{min}$ are respectively the maximum and minimum times for which injection and production rate data are available.

Because the physical processes governing fluid transport in a reservoir are nonlinear, a linear correlation between injection rate and production rate at an offset production well is not expected. The inventor has discovered that the linear correlation function can nevertheless be used to measure the tendency for high (low) injection rates at time t to be correlated with high (low) production rates at time t+τ.

The rank correlation coefficient is a measure of linear association between the ranks of two sets of data; it is particularly useful when there is large uncertainty in measurement, or when the association between the two sets of data is highly nonlinear. The rank correlation function, $\rho_{I,P}^{R}(\tau)$, expresses the dependence of the rank correlation coefficient between the ranks of I(t) at time t and P(t) at a later time t+τ on the time lag τ between injection and production rate measurements:

$$\rho_{I,P}^{R}(\tau) = 1 - \frac{6\sum_{1}^{N}[r_I(t) - r_P(t+\tau)]^2}{N(N^2-1)} \tag{7}$$

Where $r_I(t)$ is the rank of the injection rate measurement at time t and $r_P(t+\tau)$ is the rank of the production rate measurement at time t+τ. The ranks $r_I(t)$ and $r_P(t+\tau)$ range from 1 to N, where N is the number of rate measurements.

The range of the correlation function is:

$$-1 \leq \rho_{I,P}(\tau) \leq 1, \tag{8}$$

where a value of 1 indicates a perfect linear relationship with positive slope, a value of −1 indicates a perfect linear relationship with negative slope, and a value of 0 indicates no correlation between the two sets of rate data.

The plot of the correlation function versus time lag τ, referred to as a correlogram, can be used to establish which injection wells contribute most significantly to production rate responses at a selected production well and the time delays associated with those responses. This can be done by plotting correlograms for the production well and each injection well suspected to be in communication with that production well. If an injection well is in good communication with the selected production well, the correlogram will display a well-defined maximum at the time lag, $\tau_{max}$, corresponding to the characteristic response time for that injection well/production well pair. Conversely, if the injection well is not in good communication with the production well, the correlation function will be close to zero for all values of τ and the correlogram will display no well-defined maximum.

The inventor has found that $\tau_{max}$ can be correlated with reservoir properties that characterize the severity of the interwell reservoir channel. Examples of reservoir properties that can be used to characterize the severity of interwell reservoir channels include, but are not limited to, channel volume, permeability, and transmissibility. Persons skilled in the art will be familiar with methods for calculating the reservoir properties of interest, and will be able to determine which reservoir properties are most useful for characterizing the severity of a particular interwell reservoir channel.

Remedial actions to limit production of the injected fluid and increase oil production can be selected and designed after using the method of this invention to identify the source well for undesired production and characterize the reservoir channel properties. Examples of remedial actions that can be taken include, but are not limited to, reducing the rate of fluid production at the offending production well, periodically shutting in the offending producing well, reducing injection rate at the source injection well, or placing plugging substances such as cements, gels, polymers, foams, or combinations thereof in the high-permeability pathway. Persons skilled in the art will be familiar with methods for selecting and designing the most appropriate remedial action using the information determined by applying the method of this invention.

Persons skilled in the art will readily understand that the practice of the present invention is computationally intense. Accordingly, use of a computer, preferably a digital computer, to practice the invention is virtually a necessity. Computer programs for calculating correlation coefficients used in this invention could be developed by persons skilled in the art based on the teachings set forth herein.

The method of this invention is an improvement over correlation methods used in the past. This improvement can be attributed to the following key differences. First, the injection rate of the present invention is varied in a periodic (not random) manner, which reduces uncertainty in identification of which injection well is in communication with the breakthrough production well and in determination of $\tau_{max}$. Second, $\tau_{max}$ is correlated with a reservoir property of interest, such as channel volume, permeability, or transmissibility. The information obtained by practicing this method can then be used to design remedial actions for the formation.

EXAMPLE

The method of this invention was applied to quantify the degree of communication between $CO_2$ "breakthrough" production wells and surrounding injection wells in a $CO_2$ WAG flood in the Means San Andres Unit (MSAU) of West Texas. A "breakthrough" production well was a production well that experienced rapid breakthrough of $CO_2$ from one or more nearby injection wells. High $CO_2$ production rates at a breakthrough production well can cause operational difficulties and inefficient use of the $CO_2$. For example, cycling of the produced gas-oil ratio (GOR) can cause periodic overloading of the gas processing facilities, which can limit the oil production rate. Since the MSAU had several high breakthrough production wells, the method of this invention was used to determine which injection wells were the primary contributors to the high breakthrough to a given production well.

Although this example correlates gas production rate responses with gas injection rate stimuli, the method of this invention can optionally use correlations of other injection stimuli and production responses. For example, the method may correlate oil production rate response with gas or water injection rate stimuli.

Figure 2A:
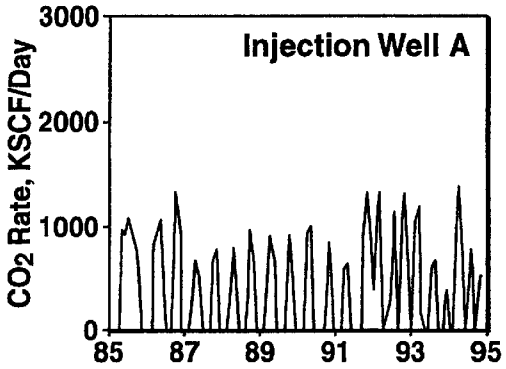
FIG. 2A, 2B, 2C, and 2D graphically illustrate injection rates of $CO_2$ in injection wells A, B, C, and D shown in FIG. 1 and FIG. 2E graphically illustrates $CO_2$ production rates from production well E of FIG. 1.
Figure 2B:
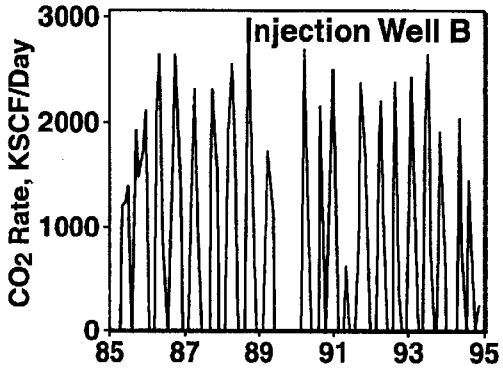
Figure 2C:
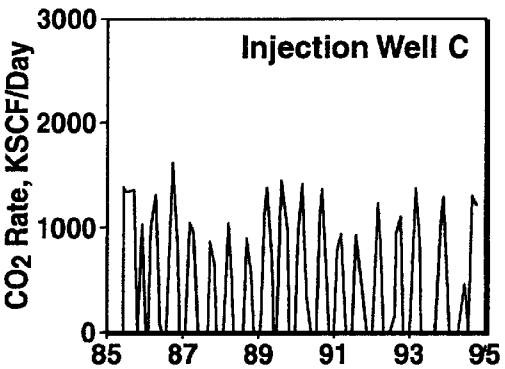
Figure 2D:
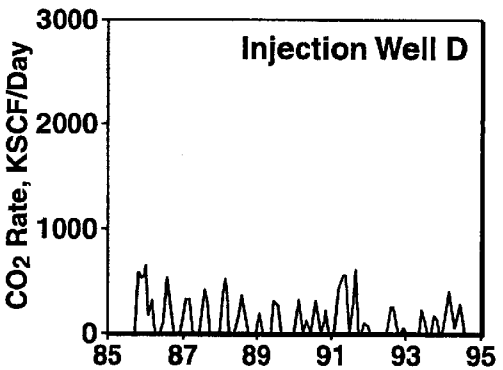
Figure 2E:
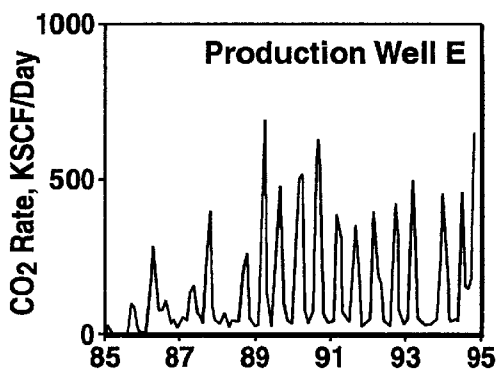

In this example, the method of this invention was applied using injection and production flow rates from a well pattern shown in FIG. 1, wherein injection wells A, B, C, and D are in fluid communication with and surround a breakthrough production well E. The $CO_2$ injection rates through injection wells A, B, C, and D for the time period 1985 through 1995 are presented in FIGS. 2A, 2B, 2C, and 2D, respectively, and the corresponding production rates of $CO_2$ from production well E are presented in FIG. 2E. The periodic variations of $CO_2$ injection rates that are shown in FIGS. 2A, 2B, 2C, and 2D were generated by injecting the $CO_2$ alternately with water in a WAG process. Thus, water was injected during the periods of zero $CO_2$ injection in FIGS. 2A, 2B, 2C, and 2D (for clarity, water injection and production rates are not shown in FIG. 2.). The first several WAG cycles had a constant WAG cycle length of two months of $CO_2$ followed by four months of water for all the injection wells, but the frequency and duration of $CO_2$ injection was later varied from one injection well to another. As a result, each injection well had a distinctive pattern of $CO_2$ injection rate that greatly reduced the uncertainty in determining which injection well was in communication with the breakthrough production well. However, by visually examining the data in FIGS. 2A–2E, it would be virtually impossible to discern any correlation between the injection rates and the production rates.

Figure 3:
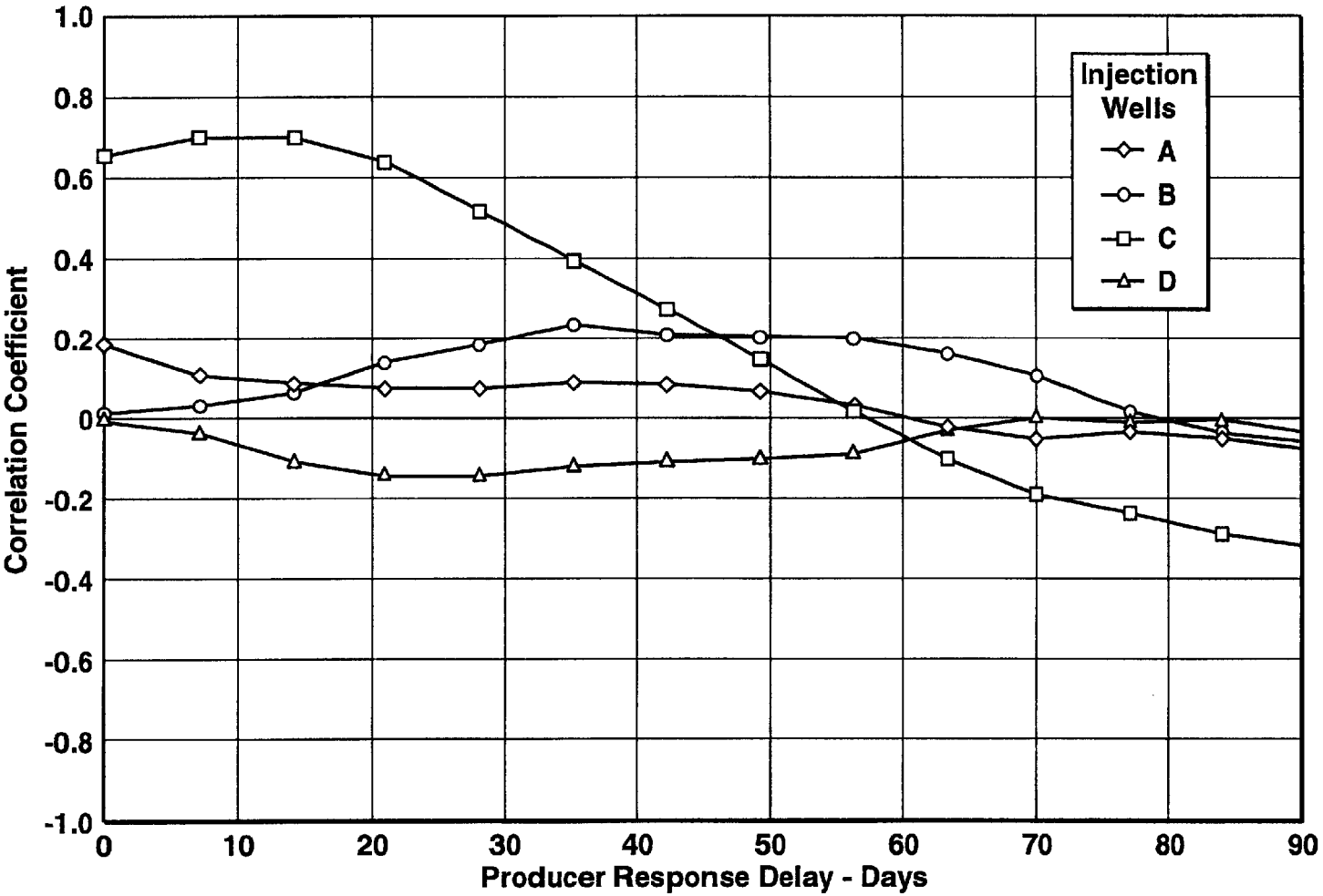
FIG. 3 illustrates the relation between correlation coefficients between the $CO_2$ injection wells A, B, C, and D of FIG. 2 and the production rate of $CO_2$ produced from production well E as a function of time delays ranging from zero to 90 days.

FIG. 3 illustrates four plots (one plot for each of the four injection wells A, B, C, and D) of the linear correlation coefficients between $CO_2$ injection and production rate measurements as a function of the time lag, $\tau$, between $CO_2$ rate measurements at breakthrough production well E and the four injection wells A, B, C, and D. Time periods during which either a production well or injection well was shut in or data were unavailable were excluded from the analysis. The correlation coefficient measures the tendency for a specified injection rate at time t to be correlated with a $CO_2$ production rate at time $t+\tau$. A correlation coefficient of 1 indicates that production rates are linearly proportional to injection rates, a value of −1 indicates that production rates are inversely proportional to injection rates, and a value of 0 indicates no correlation between two sets of data. If an injection well is in good communication with a production well, the correlation coefficient will display a well-defined maximum (usually greater than about 0.5) at the time lag corresponding to the characteristic response time for that injection well/production well pair. Conversely, if an injection well is not in good communication with the production well, the correlation coefficient will be close to zero for all values of rand will display no well-defined maximum. FIG. 3 indicates that only injection well C was in strong communication with the breakthrough production well E. The correlation coefficient between the two wells C and E had a well-defined maximum of 0.70 at a time lag of about 10 days. In contrast, as shown in FIG. 3, the absolute magnitudes of the correlation coefficients between production well E and the other injection wells A, B, and D were less than about 0.2 for any time lag, indicating weak communication between that production well and those injection wells. In this example, no other production well in the pattern of wells containing injection well C had exhibited significant $CO_2$ production. These data therefore suggest the presence of a directional high-permeability channel between injection well C and production well E.

The method of this invention was also applied to 22 other MSAU breakthrough production wells (not shown in the drawings). Thirteen injection wells were found to be in communication with single breakthrough production wells and five injection wells were found to be in communication with multiple breakthrough production wells. The response time for each well pair was also determined. For example, the response time between injection well F (not shown in the drawings) and production well G (also not shown) was between one and three days. This indicated that the high-permeability pathway between wells F and G had a smaller volume and/or higher transmissibility (compared to the surrounding reservoir) than the pathway between injection well C and production well E. These trends were confirmed by the material balance calculations described below, which indicate that the high-permeability pathway between wells F and G is about five times smaller than that between wells C and E.

Once an injection well in communication with a breakthrough production well has been identified, the volume of the high-permeability channel between the wells can be estimated by persons skilled in the art by material balance on the injectant (which was assumed to be a miscible solvent such as $CO_2$ or hydrocarbon gas), provided the fraction of injectant flowing to the breakthrough production well has attained a steady-state and saturations within the channel are reasonably uniform.

The volume of the channel can be estimated from the volume of injectant retained in the channel at steady-state:

$$V_{cl} = \frac{(1 - S_{wc})}{(1 - S_{wc} - S_{orm})} \int_{t=0}^{\tau_{\max}} [f_P I(t) - P(t)]\, dt, \tag{9}$$

where $S_{wc}$ is connate water saturation, $S_{orm}$ is residual oil saturation to miscible injectant, t=0 is the start of the miscible flood, and $f_p$ is the fraction of injectant flowing to the breakthrough production well at steady-state. $f_p$ can be estimated as:

$$f_P = \frac{\int_{t_{ss}}^{\tau_{\max}} P(t)\, dt}{\int_{t_{ss}}^{t_{\max}} I(t)\, dt}, \tag{10}$$

where $t_{s.s}$ is the time at which steady-state is attained.

To illustrate how such estimates may be used to characterize the severity of interwell high-permeability channels, channel pore volumes calculated using the procedures described above are compared with values of $\tau_{max}$ determined using the method of this invention in Table 1 below for three MSAU breakthrough well pairs, C-E, F-G (not shown), and H-I (not shown), having apparent channel volumes spanning the range observed to date. The well pairs are listed in Table 1 in order of increasing channel severity.

The data in Table 1 show that small $\tau_{max}$ correlates with small $V_{CI}$. This result indicates that $\tau_{max}$ can be used to quantify and rank the severity of interwell channels. Well pair H-I appears to be connected by a particularly severe channel that may be indicative of an interwell fracture or vugular zone. In making these estimates, saturations of $S_{wc}$=0.28 and $S_{orm}$=0.15 were assumed, consistent with relative permeability data typical of Means and other San Andres carbonate reservoirs.

Table 1. Comparison of MSAU Breakthrough Well Pairs

| Well Pair | $\tau_{max}$, days | $V_{cl}$, barrels |
|---|---|---|
| C-E | 10 | 127,000 |
| F-G | 1–3 | 26,000 |
| H-I | <1 | <5,000 |

A key to the success of the method of this invention is the periodic variation of $CO_2$ injection rate. Prior to about June 1990, WAG cycles at the injection wells in the MSAU were closely synchronized. However, after about June 1990, $CO_2$ and water bank sizes and injection rates were varied among injection wells, leading to a characteristic pattern of $CO_2$ injection rates for each injection well that was easily correlated with $CO_2$ production responses in accordance with the practice of this invention. Another benefit of the periodic variation of $CO_2$ injection rate is that the correlation function between communicating well pairs exhibited a characteristic shape that was distinctly different from the shape of the correlation functions for non-communicating well pairs. This distinction is illustrated in FIG. 3. The injection well in communication with the breakthrough production well (well C in FIG. 3) was distinguished by a correlation function in excess of about 0.5 for time lags less than about thirty days. As time lag increased beyond $\tau_{max}$, the correlation function for the communicating well pair first dropped to negative values as injection and production rates moved out of synchronization, then increased to positive values as production rates moved into synchronization with injection rates for the previous $CO_2$ injection cycle. Thus, a minimum in the correlation function occurred at a time lag corresponding to $\tau_{max}$ plus half the WAG cycle length (about 100 days for well pair C-E) and a second maximum in the correlation function occurred at a time lag corresponding to $\tau_{max}$ plus the WAG cycle length (about 190 days for well pair C-E). In contrast, the absolute magnitudes of the correlation functions between the breakthrough production well and other offset injection wells (wells A, B, and D in FIG. 3) were less than about 0.2 for any time lag and did not exhibit maxima and minima at regular time intervals corresponding to the cycle length, indicating poor correlation between injection rate changes at those wells and production response at the breakthrough production well. Correlation functions for other breakthrough well pairs in the MSAU exhibited qualitatively similar behavior.

Interpretation of the examples was relatively unambiguous because the MSAU $CO_2$ flood is relatively mature, a single injection well was in communication with each breakthrough production well, and steady-state flow appeared to have been established within the high-permeability channel. Using the method of this invention, persons skilled in the art can determine more ambiguous situations such as less mature floods, multiple injection wells in communication with a single production well, and other injectants (e.g., water, total flow rate, or LPG components). In cases where injection rates vary significantly, better correlations can be found by treating injection and production rates as functions of cumulative injected volume, rather than time, as was done in the MSAU examples considered here.

Analysis of MSAU rate data shows that early identification of interwell communication in immature floods can be aided by variation of injection rate at neighboring injection wells in an easily distinguished, unsynchronized, pattern. Each injector would then have a characteristic signature that can be correlated with production rate responses at nearby production wells. For example, in a WAG flood, WAG frequency could be varied among neighboring injection wells from the outset of the flood.

The principle of the invention and the best mode contemplated for applying that principle have been described. It will be apparent to those skilled in the art that various changes may be made to the embodiments described above without departing from the spirit and scope of this invention as defined in the following claims. For example, although the above example illustrates application of this invention using a plurality of injection wells (wells A, B, C, and D), this invention is not limited to a particular number of injection and production wells. The method of this invention could also be applied for example using one injection well and a plurality of production wells or a plurality of injection wells and a plurality of production wells. It is, therefore, to be understood that this invention is not limited to the specific details shown and described.

| Symbols | |
|---|---|
| Cov | covariance |
| $f_P$ | fraction of injectant flowing to breakthrough production well at steady-state |
| I | injection rate |
| N | number of rate measurements |
| P | production rate |
| $r_I$ | rank of injection rate data |
| $r_P$ | rank of production rate data |
| $S_{WC}$ | connate water saturation |
| $S_{orm}$ | residual oil saturation to miscible gas flood |
| t | time |
| $t_{max}$ | maximum measurement time |
| $t_{min}$ | minimum measurement time |
| $t_{SS}$ | time at which steady-state is attained |
| $V_{Cl}$ | estimated channel volume |
| $\mu_I$ | mean injection rate |
| $\mu_P$ | mean production rate |
| $\rho^L_{I,P}$ | linear correlation coefficient |
| $\rho^R_{I,P}$ | rank correlation coefficient |
| $\sigma_I$ | standard deviation of injection rates |
| $\sigma_P$ | standard deviation of production rates |
| $\tau$ | time lag between injection and production rate measurements |
| $\tau_{max}$ | time lag corresponding to maximum correlation between injection and production rate measurements |

What is claimed is:

1. A method of estimating a property of a hydrocarbon-bearing formation penetrated by at least one injection well through which fluid is injected into the formation and penetrated by at least one production well through which fluid is produced from the formation, comprising:

(a) periodically varying and measuring an injection rate of an injectant fluid through the injection well at substantially regular time intervals;

(b) measuring the production rate of a component produced through the production well;

(c) selecting a series of production well response delays $\tau$, (d) computing correlation coefficients between said injection rate and the production rate as a function of $\tau$, (e) determining the time lag, $\tau_{max}$, corresponding to the maximum correlation coefficient from the computation of step (d); and (f) using $\tau_{max}$ to characterize a reservoir property.

2. The method of claim 1 wherein the component measured in step (b) is the injectant fluid.

3. The method of claim 1 wherein the reservoir property is selected from the group consisting of channel volume, permeability, transmissibility, and combinations thereof.

4. The method of claim 1 which further comprises the step of taking remedial action based upon the reservoir property estimate, thereby increasing the ratio of hydrocarbons to injectant fluid in the production fluid.

5. The method of claim 4 wherein the remedial action is selected from the group consisting of introducing a substance into the formation, varying the injection rate, varying the production rate, and combination thereof.

6. The method of claim 5 wherein the substance is selected from the group consisting of a solid, liquid, gas, and combinations thereof.

7. The method of claim 1 wherein the computations of step (d) are performed with the aid of a computer.

8. The method of claim 1 wherein the method is carried out using at least one injection well and a plurality of production wells.

9. The method of claim 1 wherein the method is carried out using a plurality of injection wells and at least one production well.

10. A method of estimating a property of a hydrocarbon-bearing formation penetrated by at least one injection well through which fluid is injected into the formation and penetrated by at least one production well through which fluid is produced from the formation, comprising:

(a) periodically varying and measuring an injection rate of an injectant fluid through the injection well at substantially regular time intervals;

(b) measuring the production rate of a component produced through the production well;

(c) selecting a series of production well response delays, $\tau$, (d) computing correlation coefficients between said injection rate and the production rate as a function of $\tau$, (e) plotting the correlation coefficient as a function of $\tau$, (f) determining from the plot in step (e) the time lag, $\tau_{max}$, corresponding to the maximum correlation coefficient from the computation of step (d);

(g) using $\tau_{max}$ to estimate a reservoir property; and (h) selecting a remedial action based upon the reservoir property estimate.

* * * * *